United States Patent [19]

Schoonmade

[11] 4,288,177

[45] Sep. 8, 1981

[54] WALKING PLATFORM CONSTRUCTION

[75] Inventor: Wim Schoonmade, Rozenoord, Netherlands

[73] Assignee: RSV-Gusto Engineering B.V., Schiedam, Netherlands

[21] Appl. No.: 37,860

[22] Filed: May 10, 1979

[51] Int. Cl.[3] ..... E02B 17/08

[52] U.S. Cl. ..... 405/196; 180/8 E; 405/201

[58] Field of Search ..... 405/196–201; 180/8 R, 8 C, 8 E

[56] References Cited

U.S. PATENT DOCUMENTS

| | | | |
|---|---|---|---|
| 2,777,528 | 1/1957 | Jourdain | 180/8 C |
| 3,135,345 | 6/1964 | Scruggs | 180/8 E |
| 3,283,516 | 11/1966 | De Long et al. | 405/201 |
| 3,590,587 | 7/1971 | Smulders | 405/201 |
| 3,734,220 | 5/1973 | Smith | 405/198 X |

*Primary Examiner*—David H. Corbin

*Attorney, Agent, or Firm*—Young & Thompson

[57] ABSTRACT

A walking platform construction comprises a barge or work platform and a plurality of legs movable in a vertical direction and securable with respect to the barge or platform. The barge or platform has a plurality of independently movable auxiliary frames each comprising one or two legs movable and securable in vertical direction with respect to the auxiliary frame. Each auxiliary frame is disposed in a rectangular recess of the barge or platform and movable within the recess in the longitudinal direction of the recess as well as in a transverse direction. In the case in which the auxiliary frame is a long rectangular frame having two legs, each end of the frame has means to move this end in a transverse direction to the frame's longitudinal axis.

4 Claims, 6 Drawing Figures

WALKING PLATFORM CONSTRUCTION

Figure 1:
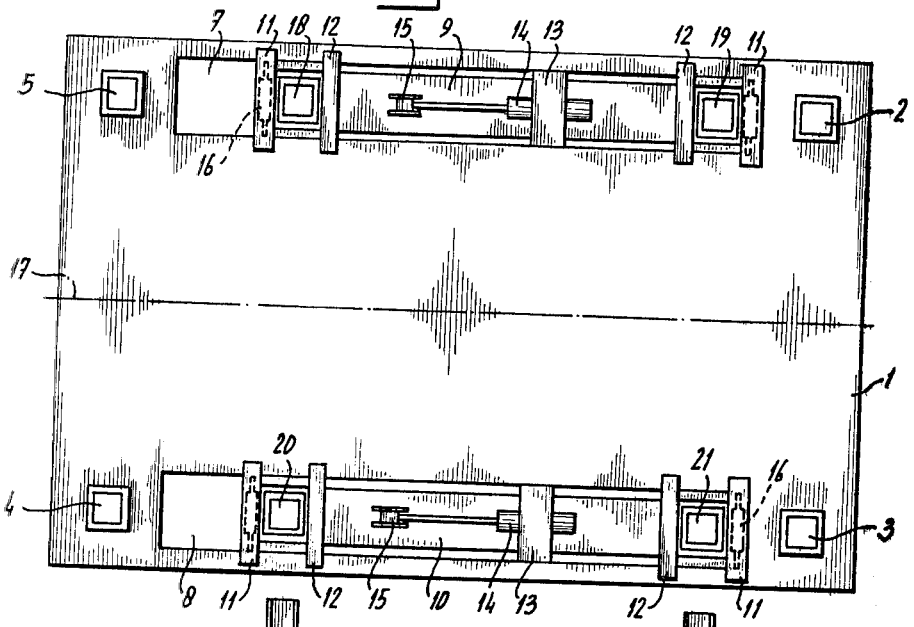

The invention relates to a walking platform construction consisting of a barge or a work platform and of a number of legs movable in a vertical direction and securable with respect to the barge or the platform, respectively, at least three of said legs having been mounted in an auxiliary frame that may be moved in the plane of the barge or the platform, respectively, and having been supported therein or thereon and in which the leg or legs may perform a horizontal displacement with respect to the barge or the platform, respectively, as well as of at least three legs on which the platform construction may rest when one or more of the horizontally movable legs has of have been raised.

A platform construction of this type has been disclosed in Dutch Pat. No. 139,134. In this known platform construction the auxiliary frame has been mounted rotatably around a vertical axis in the barge whereas the leg present in the auxiliary frame may be moved horizontally. When resting on at least three legs this known platform construction may be walked horizontally without lowering the barge onto the water surface. To that effect all the auxiliary frameshave to be aligned in the same position with all legs in the same eccentric starting position. The platform construction may thereby be walked in the direction of its longitudinal axis or by turning the auxiliary frames in each other direction making an angle with the longitudinal axis. It will be evident therefore that upon walking in longitudinal or traverse direction or walking at an angle the front of the platform construction will always point in the same direction.

The U.S. Pat. No. 3,283,516, in particular FIG. 7, discloses a platform construction in which the legs have been mounted in pairs in auxiliary frames, these auxiliary frames being movable in pairs with respect to the barge in directions perpendicular to each other. This platform construction may be walked in only two directions perpendicular to each other without lowering the barge onto the water surface.

In the case of these known platform constructions, it is impossible to turn the barge without lowering said barge onto the water surface and consequently it is not possible either to position the barge in the desired direction.

The object of the invention is to change this situation for the better, this object being attained in accordance with the invention by mounting each leg in the auxiliary frame in such a manner that the leg is solely movable in a vertical direction, this auxiliary frame being movable into two directions perpendicular to each other within a recess in the barge or the work platform, respectively. By the application of auxiliary frames movable with respect to the barge or the platform, respectively, in two directions perpendicular to each other and independently with respect to each other in accordance with the invention it has become possible in the case of fixedly positioned legs to impart to the barge or the platform, respectively, any longitudinal or traverse movement, respectively, with respect to the legs. This means that it has become possible to move the platform construction in a rotating sense in the horizontal plane without having to lower the barge onto the water surface. It is therefore also evident that the barge might be a work platform without buoyancy. The platform construction in accordance with the invention may consequently better be positioned and may be walked per se along a curved path, the front of the platform construction always pointing in the direction of the curved path.

In the case of a platform construction having an auxiliary frame including at least two legs close to the extremities of this frame and having means for moving the frame with respect to the barge as is known from the U.S. Pat. No. 3,283,516, in particular FIG. 7, it is preferred in accordance with the invention that close to the extremities of this auxiliary frame means have been provided for moving each end of said auxiliary frame in the traverse direction with respect to the longitudinal axis thereof and independently from the other end. Such an auxiliary frame has an oblong shape and may take any position making an angle with the axis lines of the platform by independent displacement of the extremities thereof.

Preferably the construction in accordance with the invention is such that the auxiliary frames have supporting means running traversely to the longitudinal axis of the pertaining recess on both sides of each leg, said supporting beams slidably engaging both the lower side and the top side of the barge or the platform, respectively, and having a length so much greater than the width of the recess that these beams rest upon or against the barge or the platform, respectively, in each position the auxiliary frame may acquire in the recess. In this way a firm support is attained by the use of relatively simple means.

Figure 2:
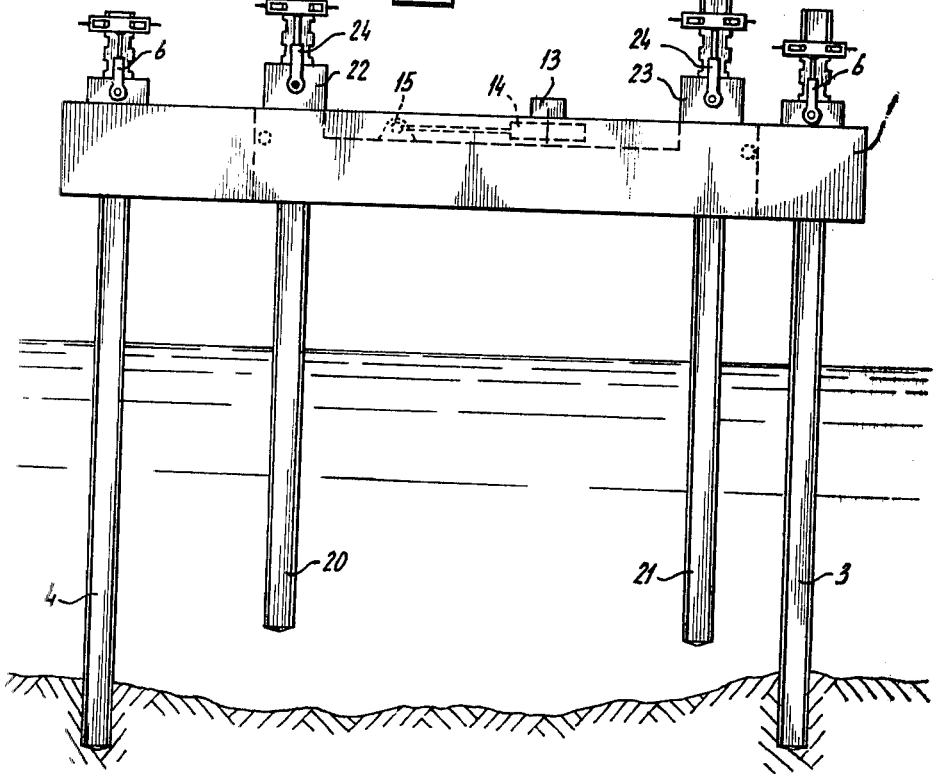
Figure 3:
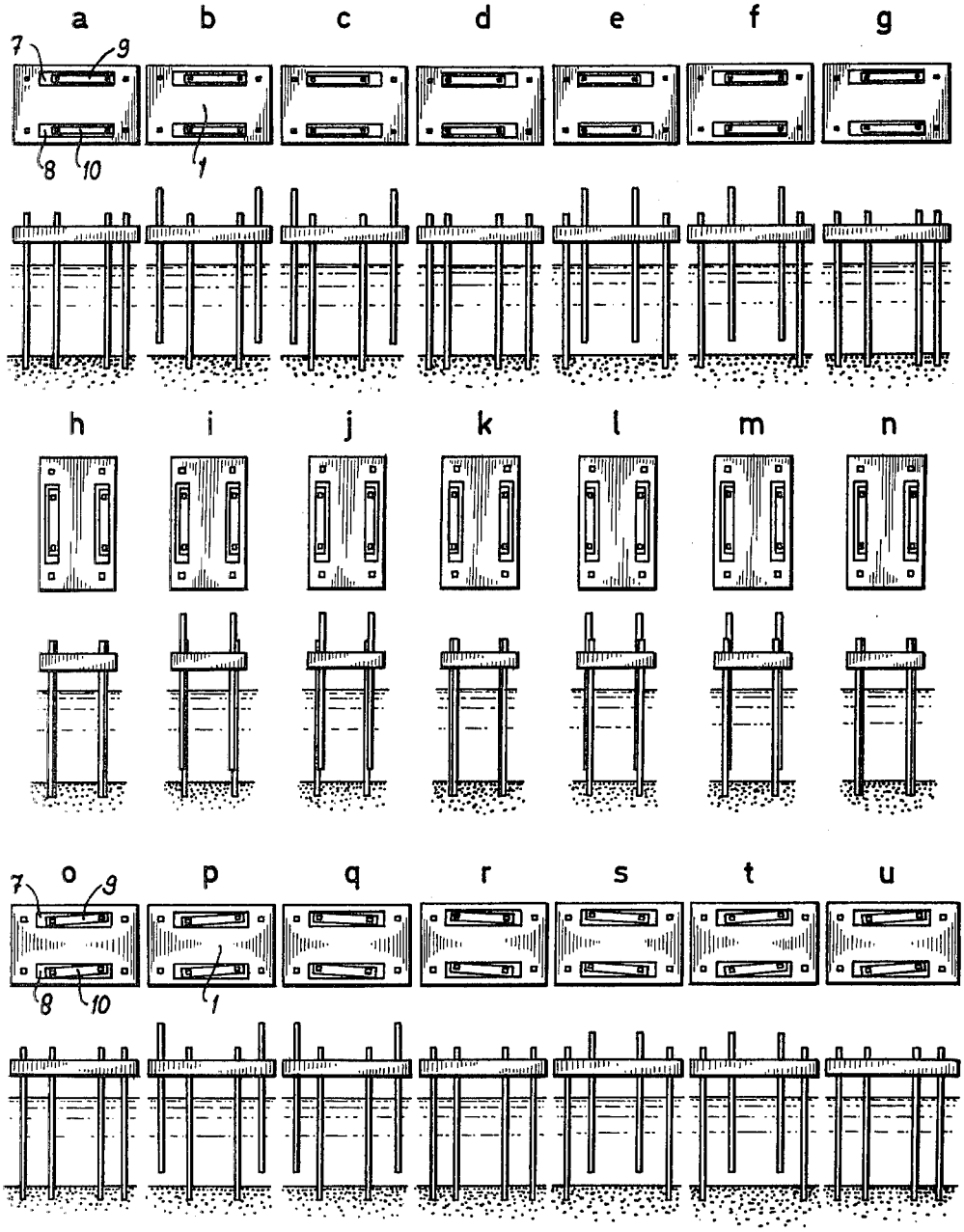
Figure 4:
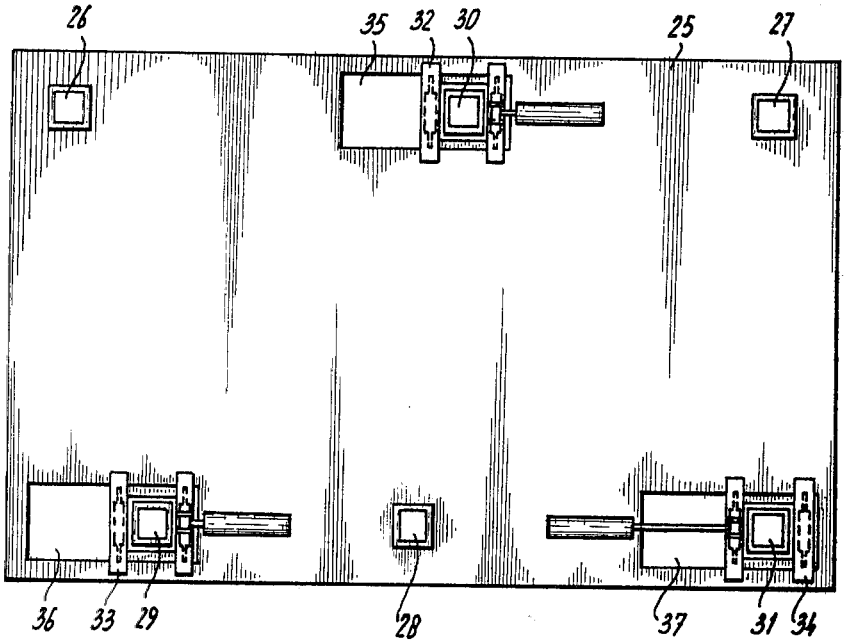
Figure 5:
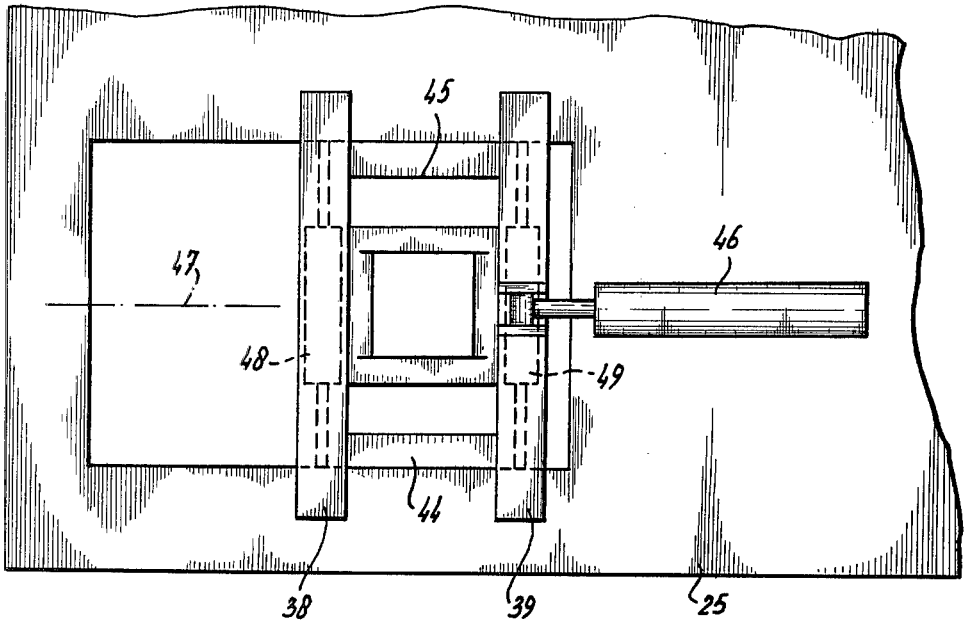
Figure 6:
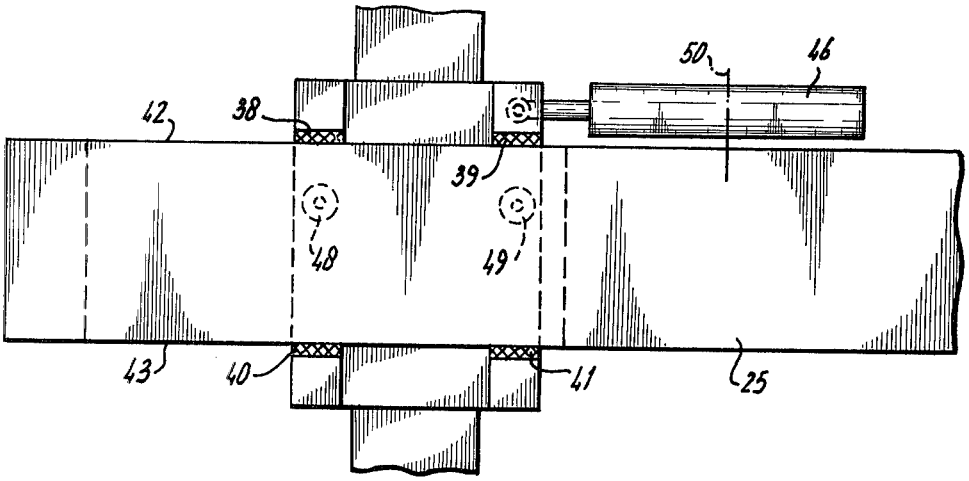

The invention will now further be elucidated with respect to the drawings, in which FIG. 1 shows a plan view of a platform construction in accordance with the invention, FIG. 2 shows a side elevation of a platform construction in accordance with the invention, FIG. 3 in *a* to *u*, inclusive, shows the different possibilities of movement of the platform construction in accordance with the invention, FIG. 4 shows a plan view of the platform construction in an other embodiment in accordance with the invention, FIG. 5 shows a plan view of a portion of FIG. 4, and FIG. 6 shows a side elevation of the portion shown in FIG. 5.

Referring to FIGS. 1 and 2 the shown platform construction consists of a barge 1 provided with legs 2 to 5, inclusive, at the corners thereof, which legs by means of the jacking mechanism indicated by 6 may be moved in vertical direction with respect to the barge.

Parallel to the longitudinal edges of the barge 1 there have been provided oblong rectangular recesses 7 and 8. In each recess 7 and 8, respectively, there has been provided an auxiliary frame 9 and 10, respectively, the width of which is narrower than the width of the recesses 7 and 8, respectively. At the extremities thereof these auxiliary frames 9 and 10, respectively, possess cross yokes 11 and 12 engaging both the top side and the lower side of the barge. These cross yokes 11 and 12, respectively have a greater length than the width of the recesses 7 and 8, respectively, and are slidable with respect to the cooperating sides of the barge 1.

At 13 there has been provided a cross beam serving as the point of application of a cylinder 14, that has been connected to the auxiliary frame at 15. By means of this cylinder the auxiliary frame may be moved in the longitudinal direction of the recesses 7 and 8, respectively.

Each yoke 11 has been provided with a pressure cylinder set 16 by means of which the left hand or right hand and of the auxiliary frame 9 and 10, respectively, in FIG. 1 may be moved within the recess 7 and 8, respectively, to the one side or the other, because this cylinder by means of its piston pushes against the side wall of the recess 7 or 8, respectively. In this way it is possible to move the auxiliary frames 9 and 10 respectively within the recesses 7 and 8, respectively in traverse directions parallel to each other but also at an angle by moving the one end to the left and the other end to the right. In this case an angle with respect to the longitudinal axis 17 has been considered.

As is apparent from FIGS. 1 and 2 the auxiliary frames 9 and 10, respectively, each possess two legs 18, 19 and 20, 21, respectively. These legs have been guided in the auxiliary frame by means of guiding constructions 22, 23 mounted between the yokes 11, 12 and cooperate with a jacking mechanism 24.

With reference to FIG. 3 there have been shown several possibilities for walking the platform construction.

FIGS. *a* to *g*, inclusive, disclose the walking in a longitudinal direction. As shown in FIG. 3*a* the auxiliary frames 9 and 10, respectively, are present in the right hand parts of the recesses 7 and 8, respectively, while the platform construction rests on all its eight legs.

With reference to FIG. 3*b* the exterior legs 2 to 5 inclusive have been raised while the platform construction only rests on the legs 18 to 21, inclusive.

As shown in FIG. 3 the platform construction has been displaced from the position of FIG. 3*b* to the right by operating the cylinders 14.

In FIG. 3*d* the exterior legs 2 to 5, inclusive, have again been lowered.

As shown in FIG. 3*e* the legs 18 to 21, inclusive, in the auxiliary frames 9 and 10, respectively, have been raised, whereas in FIG. 3*f* the auxiliary frames have again been moved to the right by means of the cylinders 14, whereupon in FIG. 3*g* the legs 18 to 21, inclusive have again been lowered and the platform construction again rests on its eight legs.

With reference to FIGS. 3*h* and 3*n* inclusive there have been shown walking procedures in a traverse direction, that is walking parallel to itself.

As shown in FIG. 3*h* the auxiliary frames 9 and 10, respectively are present in the right hand parts of the recesses 7 and 8, respectively. All legs rest on the ground.

In FIG. 3*i* the exterior legs have been raised. As shown in FIG. 3*j* the platform construction has been moved to the right with respect to the auxiliary frames resting on the legs 18 to 21, inclusive, whereas in FIG. 3*k* all legs have again been lowered. In FIG. 31 the legs of the auxiliary frames have been raised in order to move the auxiliary frames to the right as shown in FIG. 3*m* whereupon as shown in FIG. 3*n* the legs in the auxiliary frames have again been lowered.

With reference to the FIGS. 3*o* to 3*q*, inclusive, there has been shown the possibility of walking made possible by the invention, that is a rotation of the barge.

FIG. 3*o* shows the platform construction resting on all its eight legs. The auxiliary frames 9 and 10, respectively, make however an oblique angle that is to say an angle within the recesses 7 and 8, respectively. All legs rest on the ground.

As shown in FIG. 3*p* the exterior legs 2 to 5, inclusive, have been raised.

With reference to FIG. 3*q* the left hand ends as well as the right hand ends of the auxiliary frames have been moved to the other side of the recess so that an oblique position is obtained the angle of which with respect to the longitudinal axis is equal but opposite to the angle in FIG. 3*o* thus acquiring a total angle of deviation that is two times the angle with respect to the longitudinal axis. Where the platform construction in accordance with FIGS. 3*p* and 3*q* rests on the ground by means of the legs 18 to 21, inclusive, present in the auxiliary frames the factual situation is such that not the auxiliary frames but the platform has been moved with respect to the auxiliary frames so that the platform has taken an angular position, corresponding to the angular position of the auxiliary frames shown in the drawing. In other words, though not shown in this way the platform when moved from the position in FIG. 3*o* to the position in FIG. 3*q* with respect to the position in FIG. 3*o* in the position of FIG. 3*q*, will make an angle in practice that is two times the angle between the frames and the longitudinal axis.

FIG. 3*r* then shows the position in which the exterior legs have again been lowered, whereas FIGS. 3*s*, 3*t* and 3*u* again show the positions occurring when the legs of the auxiliary frames are raised, the auxiliary frames are again brought into the position of FIG. 3*o* and the legs of the auxiliary frames are then lowered again.

When repeating one of the three operations a number of times a walking of the barge in the longitudinal direction, in the traverse direction or a rotation of the barge in the horizontal plane will occur dependent on the selected movement. By combining movements in the longitudinal and the traverse directions the barge may be walked along a linear path in any direction. By combining a longitudinal and rotational movement the barge may be walked along a curved path in the longitudinal direction. By combining a traverse and a rotational movement the barge may be walked along a curved path in the traverse direction. When performing all three operations the barge may be walked along a curved path in any arbitrary direction. At the end of the total walking procedure the longitudinal axis of the barge may have acquired any arbitrary angle with respect to the starting position.

In case of the embodiment shown in FIGS. 4 to 6, inclusive, the same walking movements are possible.

This embodiment consists of a barge 25 having three legs 26, 27, 28 that may be moved solely in a vertical direction, as well as three legs 29, 30 and 31 that may solely be moved in vertical direction within the auxiliary frames 32, 33, 34.

Each of these auxiliary frames is located at an oblong rectangular recess 35, 36 and 37, respectively.

FIGS. 5 and 6 show only one of the auxiliary frames.

Each auxiliary frame possesses two upper supporting beams 38 and 39, and two lower supporting beams, 40 and 41. These supporting beams rest slidably against the upper side 42 and the lower side 43 of the barge, respectively.

These supporting beams 38 to 41, inclusive, have been coupled to each other by means of a connection construction 44, 45 in which a leg has been guided that may be moved in a vertical direction and secured. This embodiment may be constructed in the same manner as shown in FIG. 2.

Each auxiliary frame has been coupled to a pressure cylinder 46 by means of which the frame may be moved horizontally in the direction of the longitudinal axis 47 of the recess.

At 48 and 49, respectively there have been represented pressure cylinders, cooperating with the side walls of the recess by means of which the auxiliary frame may be moved in a direction transverse to the longitudinal axis 47.

The fastening of the cylinder 46 is of course such that these movements are possible, e.g. by mounting this cylinder about axis line 50.

I claim:

1. A walking platform construction comprising a barge or work platform and a number of legs movable in a vertical direction and securable with respect to the barge or platform, a plurality of auxiliary frames disposed in a plurality of elongated rectangular recesses in the barge or work platform that are parallel to each other, first power means for shifting each auxiliary frame relative to the barge or platform in a horizontal direction parallel to the longitudinal axis of the recess relative to and independently of the other said auxiliary frames, second power means for shifting each auxiliary frame relative to the barge or platform in a horizontal direction at 90° to said axis relative to and independently of the other said auxiliary frames, there being substantial clearance between each said auxiliary frame and the barge or platform in both said horizontal directions thereby to enable said shifting, each said auxiliary frame having at least one leg and means to move said at least one leg vertically relative to the associated said auxiliary frame.

2. A construction as claimed in claim 1, in which each auxiliary frame is elongated and has one leg adjacent each end thereof, and means for moving each end of each auxiliary frame transverse to the length of the auxiliary frame independently of the other end of the auxiliary frame.

3. A platform construction as claimed in claim 1, in which each auxiliary frame has only one leg vertically movable relative thereto, and means for moving each of two opposite sides of each auxiliary frame independently relative to the other opposite side of said auxiliary frame thereby to rotate the associated said one leg in either direction.

4. A construction as claimed in claim 1, each auxiliary frame having supporting beams extending transversely to the longitudinal axis of the associated recess on both sides of each leg carried by the auxiliary frame, said beams slidably engaging both the lower side and the upper side of the barge or platform and having a length sufficiently greater than the width of the associated said recess that said beams interconnect the auxiliary frames and the barge or platform in any position that the auxiliary frames may take in said recesses.

* * * * *